US005832547A

United States Patent [19]

Burroughs

[11] Patent Number: 5,832,547

[45] Date of Patent: Nov. 10, 1998

[54] SWIMMING POOL AUTOMATIC RESCUE DEVICE

[76] Inventor: Vance Burroughs, 100 Beekman St., Apt. 16D, New York, N.Y. 10038

[21] Appl. No.: 745,824

[22] Filed: Nov. 12, 1996

[51] Int. Cl.[6] ..... E04H 4/06

[52] U.S. Cl. ..... 4/504; 4/495

[58] Field of Search ..... 4/495, 496, 498, 4/503, 504; 441/80, 136; 52/169.7

[56] References Cited

U.S. PATENT DOCUMENTS

| | | | |
|---|---|---|---|
| 1,796,762 | 3/1931 | Paston | 4/504 |
| 3,955,797 | 5/1976 | Richards | 4/496 |
| 4,129,905 | 12/1978 | Niemerow | 4/496 |
| 4,136,408 | 1/1979 | Dahlbeck et al. | 4/498 |
| 4,271,542 | 6/1981 | Wood et al. | 4/495 |
| 5,023,593 | 6/1991 | Brox | 340/522 |
| 5,091,714 | 2/1992 | De Solminihac | 4/504 |
| 5,267,358 | 12/1993 | Roy et al. | 4/495 |
| 5,295,929 | 3/1994 | Weisz | 4/495 |
| 5,371,907 | 12/1994 | Horvath | 4/498 |

*Primary Examiner*—Charles R. Eloshway
*Attorney, Agent, or Firm*—Steven Horowitz

[57] ABSTRACT

An automatic rescue device employing a safety net usable in large in-ground swimming pools operable without human assistance can lift a net rapidly and effectively to the surface and is suitable to handle significant weight and rescue several people in a stable and reliable manner. It is comprised of a safety net coextensive with the perimeter of the pool submerged in the water when inactive having metal arms fastened to corners thereof, hollow cylinders running from the pool bottom to just above the top of the water surface standing at corners of the pool that house collapsible rods. In certain modes, minimal action by a human, namely operation of a remote activator, is necessary. When the swimming pool is not in use, an infra red signalling system is activated causing an electrical signal to travel through wires to activate motors at the bottom of each cylinder.

9 Claims, 5 Drawing Sheets

SWIMMING POOL AUTOMATIC RESCUE DEVICE

FIELD OF THE INVENTION

This invention is in the field of swimming pool safety devices and in particular automatic rescue devices for swimming pools utilizing safety nets.

BACKGROUND

Swimming is a very important part of the exercise regime for millions of Americans and has been for a long time. It is presently ranked as the sporting activity in America that is the second most often participated in, surpassed only by walking. A great deal of this activity takes place in the approximately 3.4 million in-ground pools located in this country.

It has long been recognized that there can be a danger to young children from having an in-ground swimming pool on one's property. Many parents who would otherwise build or buy such a swimming pool do not do so out of fear that when they are not watching one of their children could accidentally drown in the pool. There of course also exists a serious danger to older individuals from drowning in an accident. There has been a well recognized need to have safety mechanisms that ensure that swimming pools, and particularly the large in-ground swimming pools, are safe.

Accordingly, there has long been a need for a swimming pool safety device that can prevent individuals, especially children, from accidentally entering the area of and drowning in a swimming pool. Moreover, since most pool drownings occur when there is no one around to rescue the victim, there is a need to ensure that the rescue effort can be accomplished even without human intervention.

In addition, there is a need to ensure that intruders do not use a swimming pool located on one's private property. It is also essential for the maintenance of the pool that unwanted intruders be thwarted from using the pool. At present, most pool owners use fences to attempt to deter intrusion. This is inadequate since children and intruders can and will climb over the fences, thereby gaining easy access to the pool.

Moreover, since most in-ground pools are located outside, weather conditions limit their use. This points to the need for an adequate swimming pool covering so that swimming in an outdoor pool can be an all year round activity.

DESCRIPTION OF THE PRIOR ART

Various devices have been proposed to address the above needs. It is known to use a swimming pool safety apparatus that lifts a safety net in a swimming pool to save a drowning person. An example of such a swimming pool rescue net device in the prior art is U.S. Pat. No. 4,129,905 to Niemirow, which provides submerged netting in a pool that can quickly rise to the pool water's surface by means of an inflatable bladder. Niemirow's approach to the problem of a safety/rescue net apparatus in an in-ground swimming pool to prevent drowning is somewhat primitive. It relies on pumping air into rubber bladders by means of compressed air tanks in the pool area. It is not clear how effective such a system would be carrying a lot of weight rapidly since weight decompresses a bladder containing air. The bladder's reliability for rising to the surface of the water would likely be inversely proportional to the weight of the victim or victims. In addition, the bladder used by Niemirow is unstable, as evidenced by the often seen situation of an individual attempting to stand on an inflatable tube only to be thrown left or right. Accordingly, if a drowning child is successfully lifted to the surface and tries to stand at the side of the pool, the child could lose its balance and fall on the edge of the pool or even underneath the bladder into the water.

U.S. Pat. No. 5,267,358 to Roy et al. discloses a safety net apparatus consisting of a flexible protective web mounted on the bottom of a portable above ground swimming pool of the kind commonly used for children and that can be assembled in one's backyard. By turning a crank/handle mounted in tubes along the outer wall of the pool and connected to a shaft that in turn is connected to pulleys attached to cables, the web can be lifted to the surface of the water. Roy's apparatus is therefore unavailable for in-ground pools that do not have continuous outer walls. In addition, since the apparatus utilized in Roy necessarily requires someone to stand around turning a handle, it is not even designed for instant rescue but rather is designed more for preventive covering of a children's pool. Moreover, the technology of pulley and crank in Roy is inferior for raising undetermined weights rapidly for large area in-ground swimming pools.

U.S. Pat. No. 5,023,593 to Brox discloses a pool security system using a passive infrared element and underwater acoustic element activated when a person passes through the infrared detection layer. The alarm in Brox is activated only when two things occur—when the person passes through the infra red detection layer and begins entering the water and drowning. At that point a siren alarm sounds. No safety net is activated. The drawback is that if a child is already in the water drowning, responding to an alarm may not provide sufficient time in which to react and save the child—particularly since seconds matter in such a scenario. Brox also may be unable to cover blind spots in unusually configured swimming pools since the infra red detection layer is caused by rays emanating from just two source points.

OBJECTS AND ADVANTAGES

As seen from the above discussion, there continues to be a strong need for, and it is therefore an object of the present invention to provide, a rescue net apparatus usable in large in-ground swimming pools that can lift a net rapidly and effectively to the surface and that combines the best technological features and that is suitable to handle significant weight and rescue several people in a stable and reliable manner.

It is also an object of the present invention to provide a safety net apparatus for in-ground swimming pools that can be activated automatically without anyone being present (except the drowning victim or the intruder).

It is another of the present invention to provide a safety net apparatus that, at least when the swimming is not in use, can be activated to save a child even before that child reaches the actual water and begins drowning.

It is a further object of the present invention to provide a safety net apparatus for in-ground swimming pools that can be activated prior to the potential victim entering the pool itself.

Another object of the present invention to provide a safety net apparatus, security system and protective cover for in-ground swimming pools that utilizes point-to-point infrared technology so that any point in the pool is covered and there are no "blind spots".

It is also an object of the present invention to provide a safety net apparatus and security system for in-ground swimming pools of any shape.

Another object is to optionally use the safety net as a convenient pool cover when the pool is not in use so that within seconds of the push of a button the net can be raised to the surface to serve as a reliable and secure cover for in ground pools of any size, especially for hotels, colleges, resorts, etc, where pools covers are needed but not normally used due to the inordinate time to secure the cover.

Still another object is to provide a safety and security device that allows for the attachment of a protective cover to permit swimming during the winter.

It is a further object of the present invention to provide a safety net apparatus for in-ground swimming pools using infrared technology that can also function as an alarm system to detect intruders.

It is also an object of the present invention to provide a safety net apparatus for in-ground swimming pools using infrared technology that can be activated by remote control when the pool is in use and can be activated automatically when the pool is not in use by setting up infra red poles outside the perimeter of the pool that can transmit infrared signals and detect movement between the poles.

It is also a further object of the present invention to provide a safety net apparatus for in-ground swimming pools using infrared technology that can be used when a protective tent cover for the swimming pool is operative.

Yet another object of the present invention is to provide a rescue net apparatus usable in large in-ground swimming pools that can lift a safety net rapidly and effectively to the surface in the event that anyone crosses a perimeter line on the patio area outside the perimeter of the pool itself.

A still further object of the present invention is to provide a rescue net apparatus for any shape in-ground swimming pool and one that is protected from wear and tear caused by water.

DETAILED DESCRIPTION OF THE PREFERRED EMBODIMENT

Figure 1:
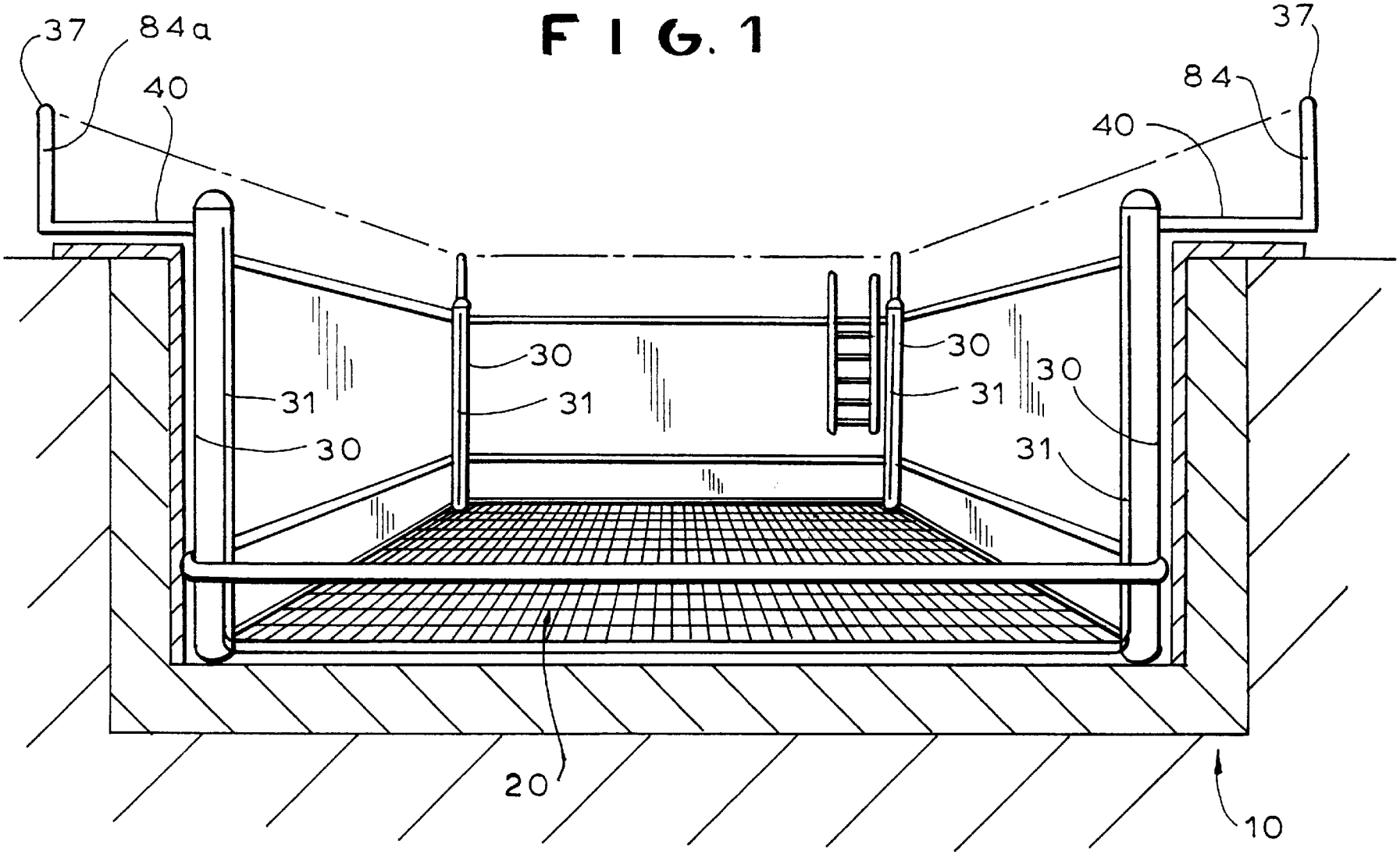
FIG. 1 is a perspective view of the swimming pool automatic rescue apparatus of the present invention in inactive condition.
Figure 2:
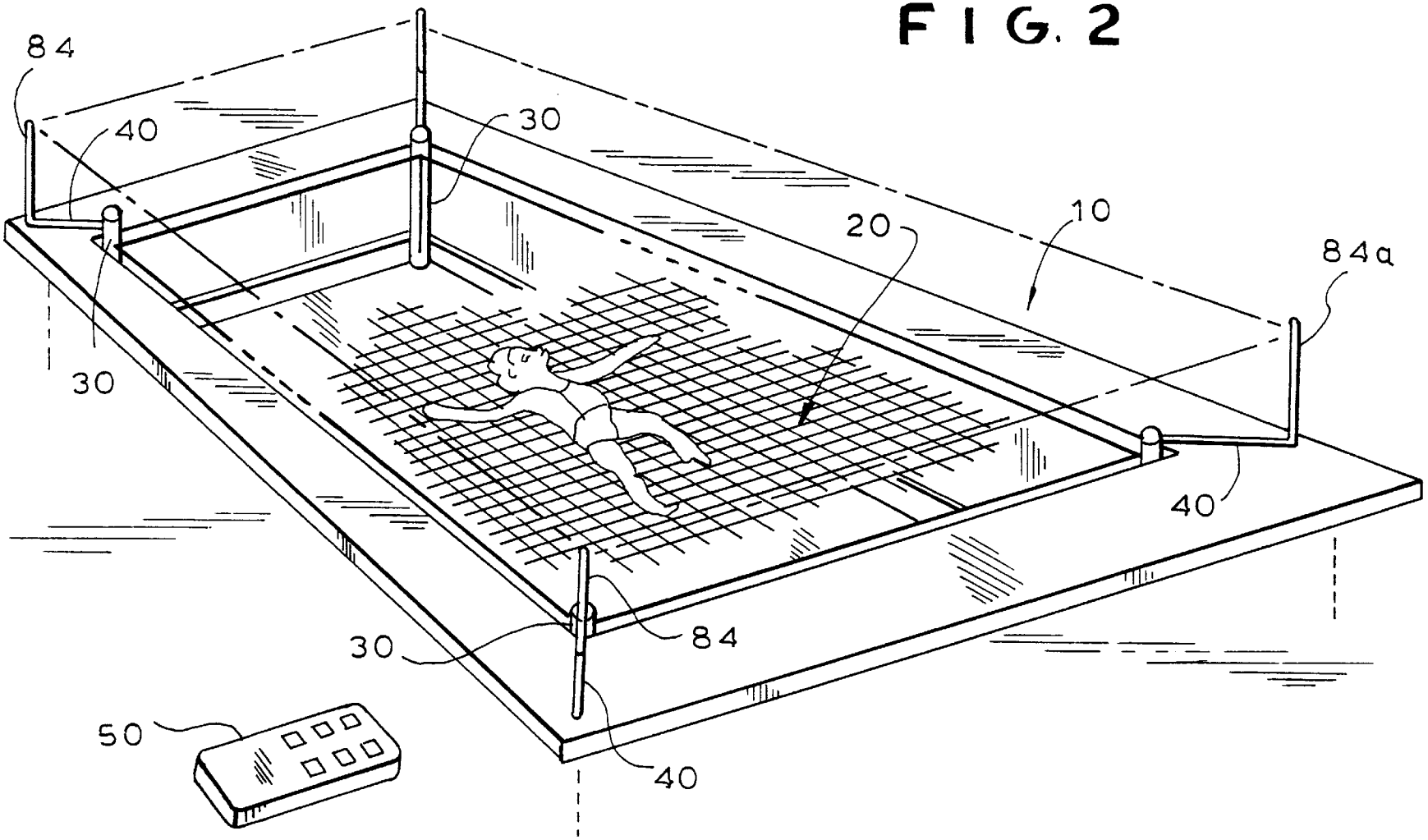
FIG. 2 depicts a perspective view of the swimming pool automatic rescue apparatus of FIG. 1 in active condition.
Figure 3:
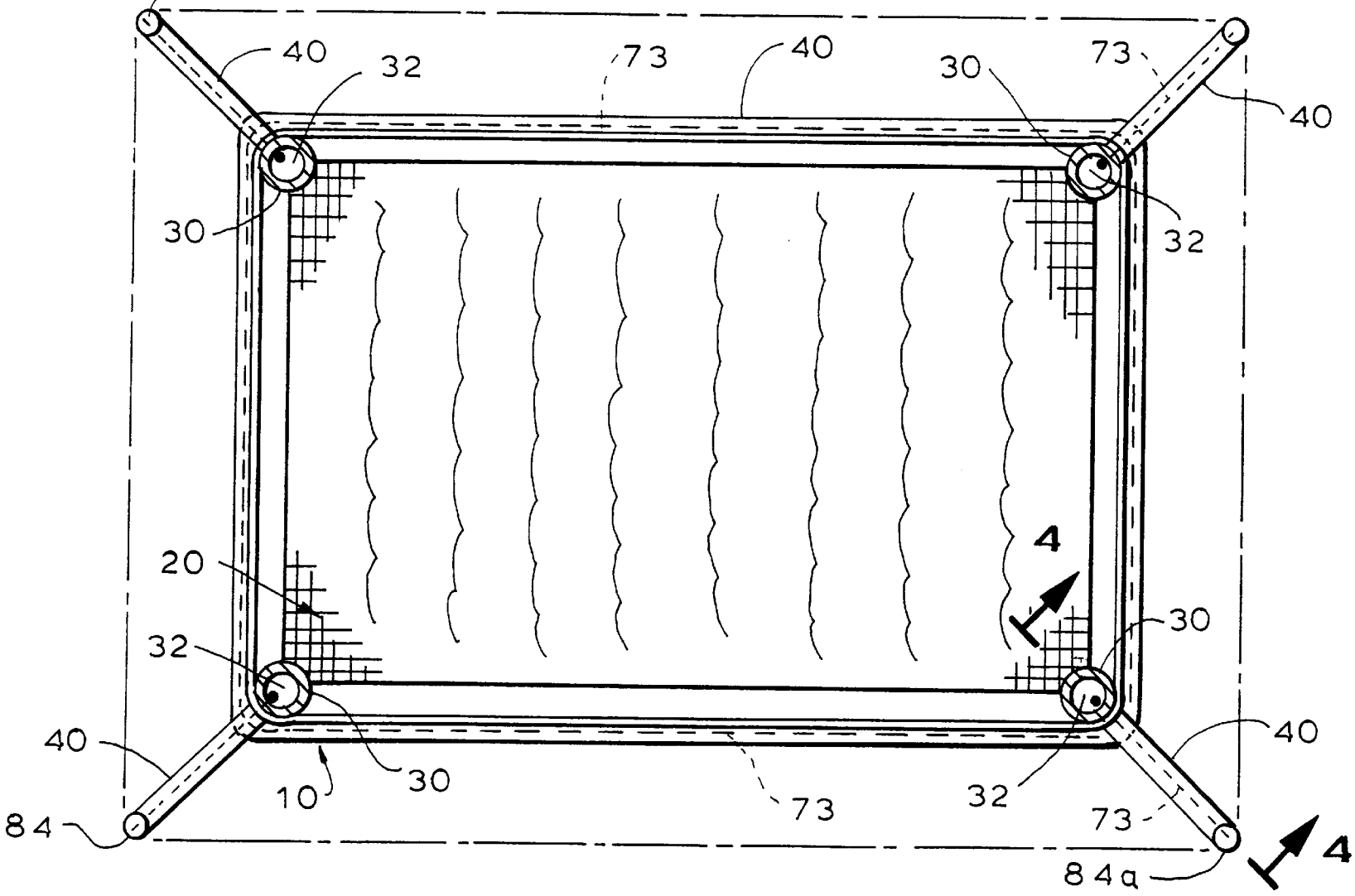
FIG. 3 is a top view depicting the signalling system of the apparatus of the present invention.

A typical embodiment of the swimming pool safety and alarm apparatus of the present invention is illustrated in FIGS. 1–5. FIG. 1 illustrates the swimming pool safety net apparatus of the present invention at the bottom of an in-ground swimming pool in a mode set for when the swimming pool is unoccupied and the device of the present invention has not been activated. The apparatus in general is designated by the numeral 10. The apparatus 10 of the present invention is depicted as functioning in an in-ground swimming pool having a surrounding patio surface, and includes safety net 20, the hollow cylinders 30 (or hollow cylindrical tubes) located and standing vertically at each corner of the pool and extending upward from the bottom surface of the pool, the plastic track 40 holding the wire 73 for the signalling system and a hand held remote activator 50 which can be used to activate the infra red signalling system and cause the net 20 to rise a sufficient margin above the water surface in the event of an emergency. It should be noted that remote 50 shown in FIG. 2 would generally not be used in the condition depicted in FIG. 2 since at described below the detection poles 84 are in place indicating that swimmers are not in the pool. It is contemplated by the present invention, however, that remote 50 could be used as a back-up activation system even when the poles 84 are in place.

The net 20 must rise sufficiently above the water surface so that if a heavy rain occurs before the drowning accident and slightly increases the water level of the pool as the water overflows the pool, the net will still successfully rise to above the water level and save a drowning victim, the assumption being that because of the nature of the structure of pools not being surrounded by an enclosed area, or because the surrounding soil has the capacity to drain or absorb overflowing water, the water level of the pool will therefore not significantly increase. The margin of the net 20 above the water level is especially important as evidenced by reported situations in which an infant crawls on top of tarpaulin placed over water in a pool before a rainstorm and then the infant drowns because enough rain water to drown the infant accumulated on top of the tarpaulin.

Safety net 20 is a tight mesh net made of material sufficiently strong to remain relatively taut and hold the weight of several people even while the net 20 is moving vertically upward carried by the motor-driven upward force of the collapsible antenna rods 32, as described further below. In addition, the material must be resistant to decay from water. Such materials that the safety net 20 may be made of may include hard rubber, strong ropes that are resistant to water decay, wire cables etc. When net 20 rises it lifts any drowning victim out of the water. In addition, since the net 20 is sufficiently taut and strong, it is not possible for a child to fall under the net 20 by being at the edge of the pool when the net rises.

Notwithstanding the above-referenced margin above water level that net 20 rises to, it is important that the net 20, in fully raised position, should not be so far above the water that any human being, even an infant could crawl between the net 20 and the water surface when the net 20 is up. Accordingly, the net 20 must be only a few inches above the water level and cover the entire perimeter of the pool and block entry to the water surface from outside the pool.

As seen in FIG. 1, safety net 20 is located at the bottom of the swimming pool when in inactive condition. In the preferred embodiment, and although the present invention can be used for any shape swimming pool, if the in-ground swimming pool is rectangular in shape, there exists four arms 24 extending from and releasably fastened around each corner of safety net 20. Arms 24 emerge into hollow cylinders 30 through vertical slit 31 and arms 24 connect to the top of collapsible rod 32 inside each of cylinders 30, as described more fully below. Arms 24 are made of metal and may be releasably attached to safety net 20 at the net's corners by any suitable means such as a releasable buckle or by looping around the space between the mesh net at each corner, just so long as the connection is secure and resistant to decay by water.

The safety net 20 would have to be constructed to fit the shape of the swimming pool. The number of arms 24 and cylinders 30 would correspond to the number of sides of the pool's perimeter. Apparatus 10 of the present invention can be used for any shape in-ground swimming pool since the cylinders 30 can be placed at any point along the perimeter of the pool. Similarly, the infra red poles, described in detail below, can be placed at any point on the patio surface outside the perimeter of the pool.

Figure 4:
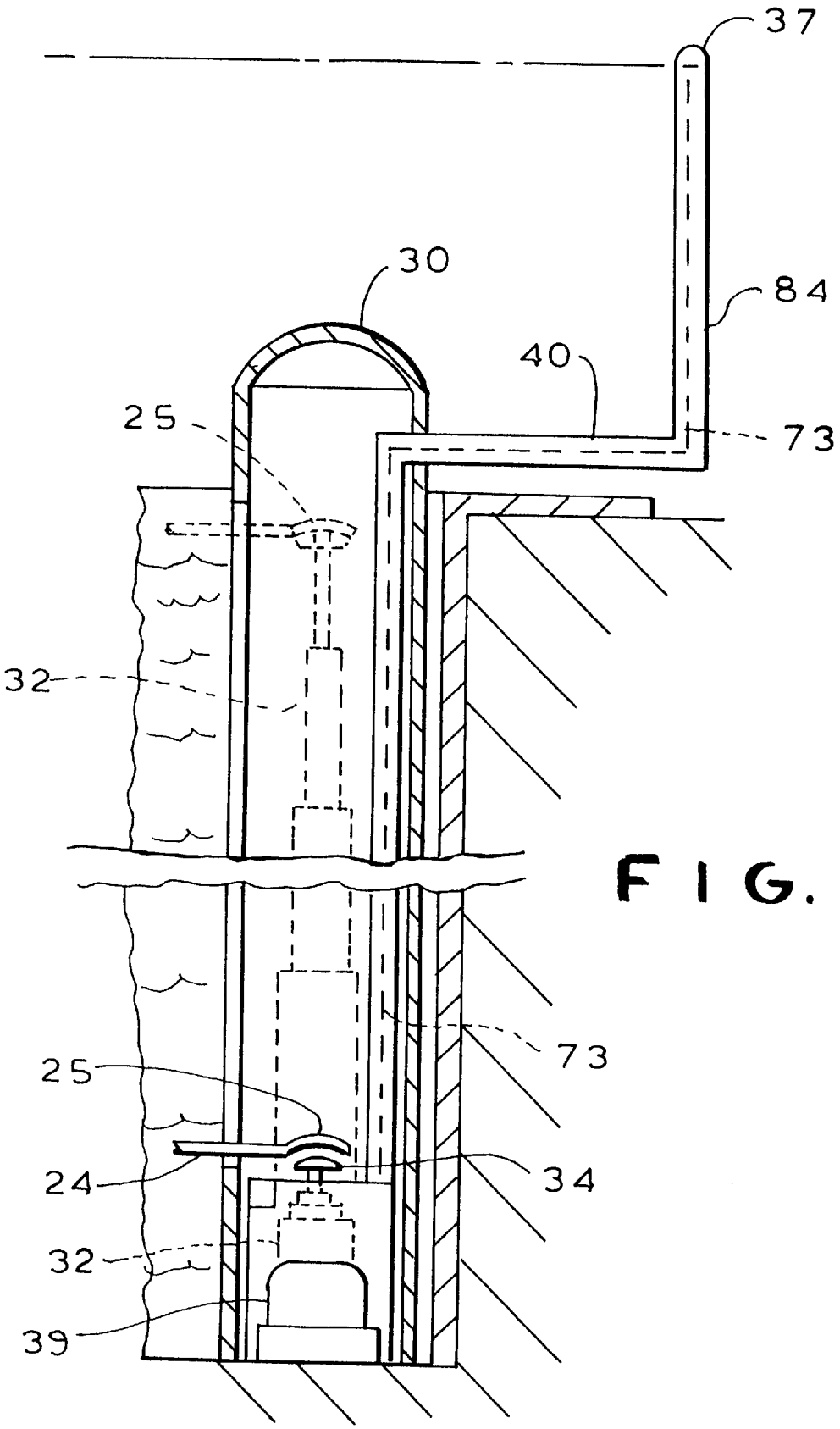
FIG. 4 depicts a vertical cross-sectional view of the cylinder and infra red detection pole of the present invention taken along line 4—4 of FIG. 3.

As best seen in FIG. 4, cylinders 30 are hollow cylindrical housings or tubes made of hard plastic having a vertical slit 31 running from the bottom to the top thereof. Vertical slits 31 are water impermeable and are there in order to allow the insertion of arms 24 into the cylinders 30 while permitting arms 24 to be run upward along the length of cylinders 30 in response to the activation of a signal and to be lowered in response to another signal. Vertical slits 31 have O-ring rubber insulation and waterproof axle grease which lubricates the slit in order to allow arms 24 to move freely up and down.

One end of arms 24 are attached to thin antenna-like collapsible rods 32 that ride up and down the cylinder 30. The lowest end of each cylinders 30 begins at the bottom of the swimming pool and the top end of cylinders 30 jut out just above the surface of the water in the pool. The collapsible rods 32 have at their top end flat steel heads 34 that act as male parts and snugly fit into the oval female concave palms 25 at the end of arms 24 when rod 32 is connected to palm 25. Rods 32 dip into the motors 39 that rest at the bottom of cylinders 30.

Motors 39 contain ordinary gears known in the art to drive rods 32 upward. When rods 32 move upward the portions telescoped or collapsed within rods 32 open up for greater extension. When all telescoped or collapsed parts of rods 32 are fully extended, rods 32 cease moving upward. At this point the top of rods 32 should be at the very top end of cylinders 30 and above the water surface of the pool. Rods 32 can be moved back down to their original position by simply reversing the same action as a result of signal received by the motor 39 from the infra red detection poles 84 through wires 73 when the rods 32 are fully extended. This signal would be initiated by remote 50.

The Signalling System

The motors 39 at the bottom of the hollow cylinders 30 are activated electrically using wire connections that run to the motors 39 from the infra red motion detector poles located on the patio surface approximately three feet outside the perimeter of the swimming pool. The insulated wires 73 are encased in insulating plastic and wires 73 form a circuit connecting each of the motors 39 to each other and to the infra red poles 84 on the patio surface outside the pool. The circuit is also linked, at the bottom of one of the infra red detector poles 84*a*, to a relocated power source (not shown, located away from pool) that converts AC current into DC current for the purpose of operating motors 39. The wires 73 run through the hollow cylinders 30 from the motor 39 at the bottom of each cylinder 30 and through elongated plastic tracks 40 along the patio surface and to a corresponding infra red pole 84 whose bottom point is located approximately three feet from the perimeter of the pool (and three feet from a point near the top of cylinders 30) and which are standing vertically perpendicular to the patio surface. The insulated wire 73 is secured by an elongated plastic track 40 that runs along the same path as the wire 73.

As an alternative to using the relocated power supply as the primary source of power, this invention also contemplates having motors 39 containing within them batteries encased inside the housing of the motors at the bottom of cylinders 30. The batteries would then act as the primary source of power for the motors. The relocated power supply would function in this embodiment as (i) a battery recharger and (ii) a back-up power source.

In a preferred embodiment, the infra red detection poles 84 may be set up so that there is one pole 84 standing approximately three feet away along the patio surface from each cylinder 30. This is not a requirement of the invention but merely a convenience. Insulated wire 73 within plastic track 40 then runs approximately three feet along the patio surface outside the pool from each cylinder 30 to each pole 84. The height of each infra red pole 84 may be approximately three feet or any height sufficient to accomplish its purpose of detecting human movement.

Operation of the Apparatus

If the swimming pool is in use, the infra red detection poles 84 are deactivated with respect to detecting motion across a line between the poles. In addition to being deactivated poles 84 are detachable and would be removed when the swimming pool is in use in order to avoid collision with swimmers getting in and out of the pool. In such a case, an infra red receiver box attached to the relocated power supply (not shown), receives an infra red signal, in the preferred embodiment, from a remote activator 50. Remote activator 50 is located outside the pool and in some cases may even be located outside the pool area. In either case remote activator 50 is held by someone within sight of the outdoor in-ground swimming pool. In other words, while the outside in-ground pool is full with swimmers who may include children, a parent or lifeguard holding the remote can be outside the pool or even inside the nearby house but within sight of the pool. In the event someone is drowning the person holding remote 50 pushes a button on the remote 50 that transmits an infra red signal to the infra red receiver box attached to the relocated power supply. An electrical signal is then transmitted by the relocated power supply through the wires 73 in plastic track 40 running to the perimeter of the swimming pool and through the circuit between the cylinders 30 around the perimeter of the swimming pool and running down through each of the cylinders 30 to the motors 39 thereby activating the motors 39 and causing rods 32 to ride up cylinders 30. Since the cylinders 30 are connected rigidly to the arms 24 attached to the corners of safety net 20, the entire net 20 automatically rises rapidly to just above the surface of the water.

When the swimming pool is not in use, the infra red signalling system may be activated without the remote 50. In that case, the electrical signalling system is activated when an intruder crosses an invisible line connecting any two infra red poles 84. The infra red poles detect movement by animate objects across a line between the poles and this triggers the same response triggered by remote activator 50. That is, the infra red signal between the poles 84 is interrupted by the intruding object. Since the central pole 84*a* is connected to the power supply and all of poles 84 are electrically wired to each other, this interruption triggers an electrical signal to be sent to each of the poles 84 through insulated wires 73 and this electrical signal runs to the perimeter of the pool and around the perimeter of the pool through wires 73 and runs through each of cylinders 30 to the motors 39 through insulated wires 73.

In this mode, the apparatus 10 of the present invention is functioning as an electrical alarm that causes the safety net 20 to rise to the surface of the water and thereby frustrate the intruder's attempt to swim in the pool. Likewise, if the "intruder" is a child who may inadvertently continue walking toward the pool and for whom it would be dangerous to fall into the pool, the signalling system is also functioning as a safety device when the net 20 rises to save the child.

Additionally, in the preferred embodiment, the signalling system can also include a siren alarm activated by disruption of the infra red signal between poles 84 that wakes up the sleeping property owner or private security services or police at the same time that the net 20 is activated. The present invention also contemplates being used in conjunction with an ordinary pool cover such as a tarpaulin during winter in the event the pool owner does not want the pool used during the winter. In such a case, the infra red activated siren is particularly useful because there have been reported cases of infants drowning in water accumulated on top of a tarpaulin or pool cover.

When the swimming pool is not in use during the summer, the device of the present invention may also be maintained with the safety net 20 is fully raised position functioning as a preventative protective cover to prevent intruders from using the pool. Unlike other safety "nets", the safety net 20 of the present invention has not air stored within it and as a result would not deflate and lose its effectiveness over time as a cover.

Protective Canopy Cover for Winter

Figure 5:
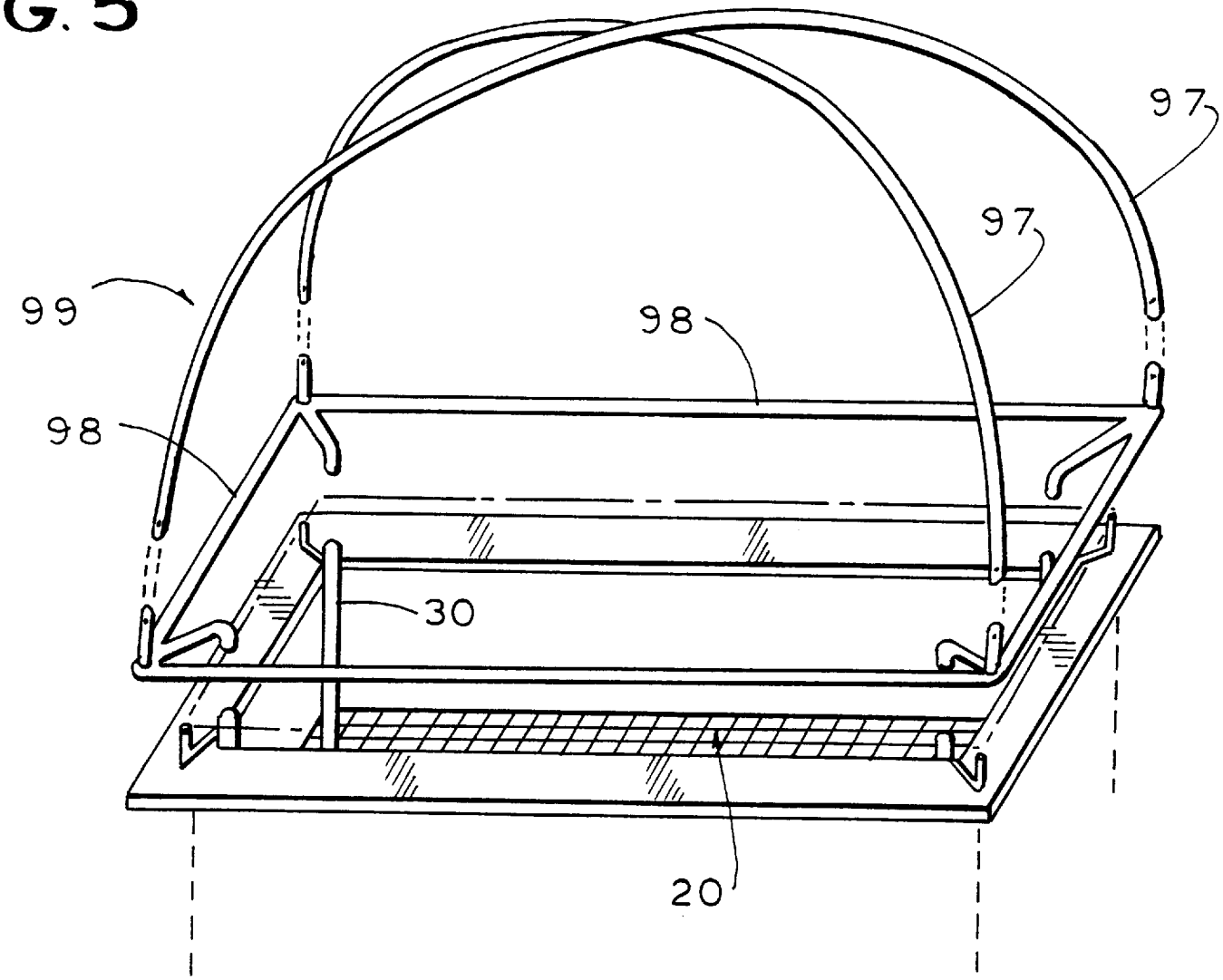
FIG. 5 depicts the protective cover of the present invention.

The following option is described in the event the pool owner wants to use the pool during the winter. As seen in FIG. 5, attachable to the tops of the hollow cylinders 30 are hollow semicircular poles 97 that define the support for a canopy tent 99. Canopy tent 99 is formed by simply draping and attaching a fabric over poles 97. Further support for poles 97 can be provided by connecting poles 98. Canopy tent 99 is useful as a protectivecover for the swimming pool during the winter or during inclement weather. When tent 99 is up, apparatus 10 of the present invention does not function as a safety rescue device but merely as an alarm. Note that this is possible because the entire safety net 20 may be removed from the swimming pool area by detaching each corner of the net 20 from corresponding arms 24.

It is to be understood that while the apparatus of this invention have been described and illustrated in detail, the above-described embodiments are simply illustrative of the principles of the invention. It is to be understood also that various other modifications and changes may be devised by those skilled in the art which will embody the principles of the invention and fall within the spirit and scope thereof. It is not desired to limit the invention to the exact construction and operation shown and described. The spirit and scope of this invention are limited only by the spirit and scope of the following claims.

What is claimed is:

1. An in-ground swimming pool rescue apparatus comprising:

a safety net having a shape adapted to conform to the shape of a perimeter of the swimming pool and having metal arms fastened at predetermined locations to a peripheral edge of the net, said safety net being submerged underwater at a bottom surface of the swimming pool when in an inactive condition and rising to a point above the water surface when the apparatus is activated thereby causing the metal arms and the net to be raised, generally hollow cylinders adapted to be positioned at predetermined locations around the perimeter of the swimming pool and stand vertically on the bottom surface of the swimming pool and extend upward to just above water surface, said cylinders having waterproof slits running vertically therethrough for insertion of the metal arms into the cylinders, collapsible rods inside the cylinders that ride up and down inside the cylinders, said collapsible rods having tops shaped for receiving and firmly engaging an end of said metal arms, said collapsible rods attached to motors located at a bottom of the cylinders so as, when activated by the motor, to be caused to move up the cylinder until the rod is fully extended, and infra red detection poles associated with each cylinder and adapted for standing on a patio surface outside the perimeter of the swimming pool, said infra red detection poles electrically connected to the motors by insulated electric wire running down the cylinders from the poles and adapted for running around the perimeter of the swimming pool and for being electrically connected to a power source, said infra red detection poles capable of sending an electric signal through the wire to activate the motors whenever movement by animate objects between the poles is detected.

2. The apparatus of claim 1, wherein said tops of said collapsible rods are flat and firmly engage a female end of said metal arms.

3. The apparatus of claim 1, wherein the infra red detection poles are removable.

4. The apparatus of claim 1, further including a tent canopy formed above the swimming pool, said tent canopy comprising rigid tubular arches attached to a top of each cylinder, said rigid tubular arches extending from one cylinder to another nonadjacent cylinder, and a fabric draped over the arches.

5. The apparatus of claim 1, wherein the motors are adapted to have a primary source of power and a back-up source of power.

6. An in-ground swimming pool rescue apparatus comprising:

a safety net having a shape adapted to conform to the shape of a perimeter of the swimming pool and having metal arms fastened at predetermined locations to a peripheral edge of the net, said safety net being submerged underwater at a bottom surface of the swimming pool when in an inactive condition and rising to a point above the water surface when the apparatus is activated thereby causing the metal arms and the net to be raised, generally hollow cylinders adapted to be positioned at predetermined locations around the perimeter of the swimming pool and stand vertically on the bottom surface of the swimming pool and extend upward to just above water surface, said cylinders having waterproof slits running vertically therethrough for insertion of the metal arms into the cylinders, collapsible rods inside the cylinders that ride up and down inside the cylinders, said collapsible rods having tops shaped for receiving and firmly engaging an end of said metal arms, said collapsible rods attached to motors located at a bottom of the cylinders so as, when activated by the motor, to be caused to move up the cylinder until the rod is fully extended, and a remote activator that can transmit an infra red signal to a relocated power supply to signal and activate the motors, said relocated power supply adapted to be electrically connected to the motors by insulated electric wire running to and around the perimeter of the swimming pool and running down the cylinders.

7. The apparatus of claim 6, wherein said tops of said collapsible rods are flat and firmly engage a female end of said metal arms.

8. The apparatus of claim 6, further including a tent canopy formed above the swimming pool, said tent canopy comprising rigid tubular arches attached to a top of each cylinder, said rigid tubular arches extending from one cylinder to another nonadjacent cylinder, and a fabric draped over the arches.

9. The apparatus of claim 6, wherein the motors are adapted to have a primary source of power and a back-up source of power, the relocated power supply being the back-up source of power.

* * * * *